US010274186B1

(12) United States Patent
Grandsart

(10) Patent No.: US 10,274,186 B1
(45) Date of Patent: Apr. 30, 2019

(54) LIGHTING DEVICE WITH MOUNTING HOOD HAVING INTERNAL THREADED SEALING DEVICE

(71) Applicant: Appleton Grp LLC, Rosemont, IL (US)

(72) Inventor: Dawn M. Grandsart, Chicago, IL (US)

(73) Assignee: Appleton Grp LLC, Rosemont, IL (US)

( * ) Notice: Subject to any disclaimer, the term of this patent is extended or adjusted under 35 U.S.C. 154(b) by 0 days.

(21) Appl. No.: 15/818,391

(22) Filed: Nov. 20, 2017

(51) Int. Cl.

| | |
|---|---|
| ***F21V 3/00*** | (2015.01) |
| ***F21V 17/12*** | (2006.01) |
| ***F21V 23/00*** | (2015.01) |
| ***F21V 23/02*** | (2006.01) |
| ***F21V 31/00*** | (2006.01) |
| ***F21Y 115/10*** | (2016.01) |

(52) U.S. Cl.
CPC ..... *F21V 31/005* (2013.01); *F21V 3/00* (2013.01); *F21V 17/12* (2013.01); *F21V 23/002* (2013.01); *F21V 23/02* (2013.01); *F21Y 2115/10* (2016.08)

(58) Field of Classification Search
None
See application file for complete search history.

(56) References Cited

U.S. PATENT DOCUMENTS 9,574,751 B1 * 2/2017 Eubanks ..... F21V 17/00

OTHER PUBLICATIONS

Heyco Cordgrip Brochure: Heyco V-O Nylon and Metal Liquid Tight Cordgrips, 2013, 20 pages.
Appleton Brochure: Installation Instructions for Industrial Mercmaster LED Low Profile Luminaire, 2016, 10 pages.

* cited by examiner

*Primary Examiner* — Kristy A Haupt
(74) *Attorney, Agent, or Firm* — McDonnell Boehnen Hulbert & Berghoff LLP

(57) ABSTRACT

A luminaire including a mounting hood and a luminaire housing attachable to the mounting hood, wherein the mounting hood includes an upper aperture positioned on an upper portion of the mounting hood adapted for secured engagement with a lower end of a downwardly extending conduit, and a lower aperture in communication with the upper aperture positioned in an interior of the mounting hood, a water tight cord grip in threaded engagement with the lower aperture of the mounting hood, wherein the water tight cord grip has a base positioned beneath an upper portion of the water tight cord grip, and wherein electrical wiring may pass through the base and upper portion of the water tight cord, and also pass through the lower aperture and upper apertures of the mounting hood.

16 Claims, 5 Drawing Sheets

LIGHTING DEVICE WITH MOUNTING HOOD HAVING INTERNAL THREADED SEALING DEVICE

FIELD

Figure 1:
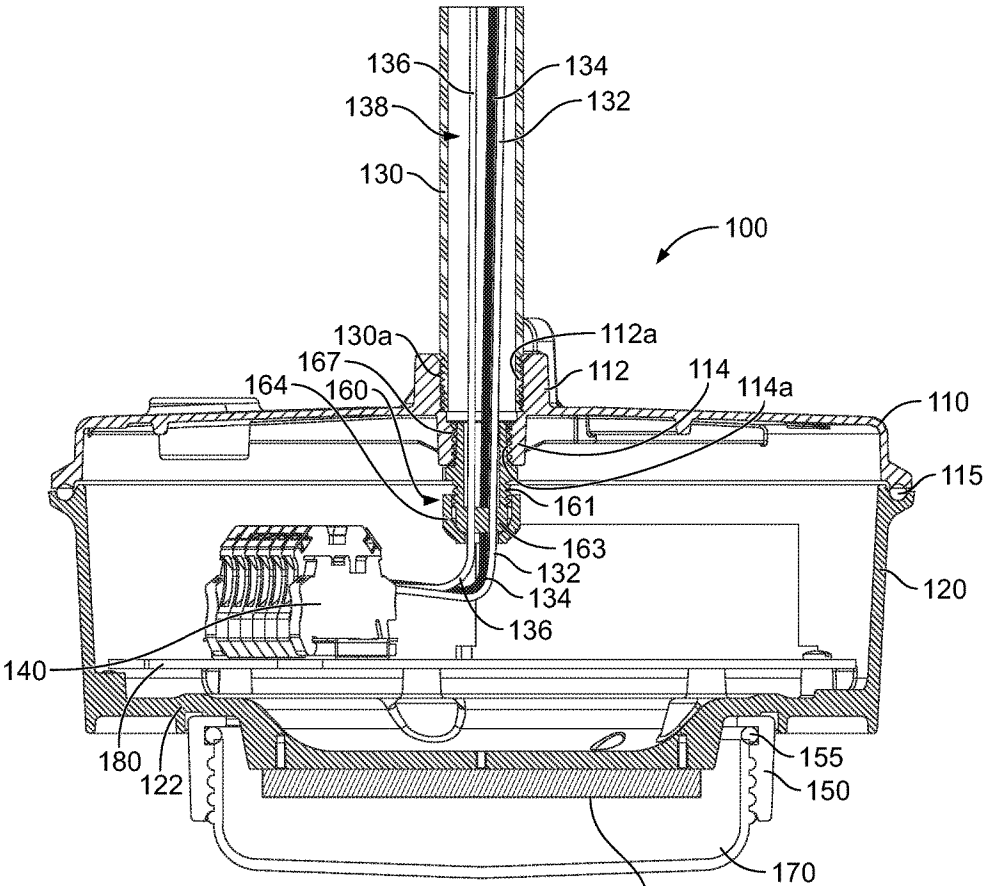

The present disclosure relates to the field of luminaires.

BACKGROUND

Luminaires or lighting fixtures have found wide application in a variety of different industries. The term "luminaire" as used herein is any device that emits light. A typical industrial setup, such as an oil refinery, can include at least 100 luminaires arranged near the ceiling of the industrial setup. A luminaire may be mounted from a ceiling of an industrial environment to provide lighting for the operations below. The luminaire may hang from the ceiling by a pendant mounting fixture. For example, a conduit may extend downwardly from the ceiling where it may be threaded into engagement with a mounting hood of the luminaire. A luminaire housing and the mounting hood may be sealingly engaged to prevent the entry of debris or water into the luminaire which could adversely affect the electrical components, (such as lighting elements or LEDs) positioned within the luminaire. Electrical wiring may extend through the downwardly extending mounting conduit and through an opening in the mounting hood, where the wiring may be connected to electrical components such as lighting elements or LEDS positioned within the luminaire. However, water may enter the downwardly extending conduit due to various reasons, which may include condensation or leakage of rain water. The accumulation of water in the downwardly extending conduit may cause water to seep through the mounting hood and into the luminaire. This is not desired as it can cause failure of the electrical components, such as lighting elements or LEDS within the luminaire. In addition, water entering the luminaire may cause a safety hazard, which needs to be avoided. Accordingly, there is a need to provide a way to prevent water that enters, or condenses within, the downwardly extending conduit from entering the luminaire.

SUMMARY

The present disclosure provides a device for preventing water entering, or condensing within, a downwardly extending conduit from entering a luminaire. The mounting hood of the luminaire includes an upper opening or aperture into which an end of a downwardly extending conduit may be threaded to, or otherwise secured to. Beneath the upper opening is a lower opening or aperture in the interior of the mounting hood positioned beneath, and in communication with, the upper opening of the mounting hood. A water tight cord grip is threaded into the lower opening in the interior of the mounting hood. As used herein, the term "water tight cord grip" means any device that provides a water tight seal between an electrical wire and an element through which the electrical wire passes through. Electrical wiring from the downwardly extending conduit, or from electrical components positioned within the luminaire, passes through the water tight cord grip where electrical wiring within, or passing through, the conduit may be electrically connected to electrical wiring or electrical contacts from electrical components, such as lighting elements or LEDs within the luminaire. Thus, wiring from or to electrical components within the luminaire may pass through the water tight cord grip where they may be electrically connected to electrical wiring within the downwardly extending conduit, or electrical wiring from within the conduit may pass through the water tight cord grip and connected to electrical wiring from, or electrical contacts positioned on, electrical components within the luminaire. Water within the downwardly extending conduit is prevented from seeping into the luminaire by the water tight cord grip threaded into the lower opening in the interior of the mounting hood of the luminaire, and may pool above a base in the water tight cord grip. In this manner, water is prevented from coming into contact with electrical components, such as lighting elements or LEDs within the luminaire, thereby preventing damage to the electrical components or preventing a short circuit situation.

In one aspect, a luminaire is provided including a mounting hood, and a luminaire housing attachable to the mounting hood, wherein the mounting hood includes an upper aperture positioned on an upper portion of the mounting hood adapted for secure engagement with a lower end of a downwardly extending conduit, wherein the mounting hood includes a lower aperture positioned in an interior of the mounting hood which is in communication with the upper aperture of the mounting hood, wherein the lower aperture includes threads, a water tight cord grip having an upper portion with threads in threaded engagement with the threads of the lower aperture of the mounting hood, wherein the water tight cord grip has a base positioned beneath the upper portion of the water tight cord grip; and wherein electrical wiring may pass through one or more openings in the base and through the upper portion of the water tight cord, and also pass through the lower aperture positioned in the interior of the mounting hood and pass through the upper aperture positioned on the upper surface of the mounting hood In another aspect, a method of preventing the entry of water into a luminaire is provided, including the steps of: (i) providing a luminaire having a mounting hood attachable to a luminaire housing, wherein the mounting hood includes an upper aperture positioned on an upper portion of the mounting hood adapted for secured engagement with a lower end of a downwardly extending conduit, wherein the mounting hood includes a lower aperture positioned in an interior of the mounting hood which is in communication with the upper aperture of the mounting hood, wherein the lower aperture includes threads; (ii) threading a water tight cord grip having an upper portion with threads into engagement with the threads of the lower aperture of the mounting hood; (iii) securing the mounting hood to a lower end of a downwardly extending conduit; (iv) passing electrical wiring through the upper and lower apertures of the mounting hood and through the water tight cord grip; (v) tightening a base compressing element into threaded engagement with a lower portion of the water tight cord grip; (vi) providing an electrical connection between electrical wiring within the conduit and one or more lighting elements within the luminaire housing; (vii) securing the luminaire housing to the mounting hood; and (viii) trapping water that drips down an interior of the conduit above a base of the water tight cord grip positioned beneath the upper portion of the water tight cord grip to prevent entry of the water into the luminaire housing beyond the water tight cord grip.

BRIEF DESCRIPTION OF THE ACCOMPANYING DRAWINGS

FIG. 1 is a cross-sectional view of luminaire 100 having mounting hood 110 and luminaire housing 120, and water tight cord grip 160 positioned within a lower opening in the mounting hood 110, according to an example embodiment.

Figure 2A:
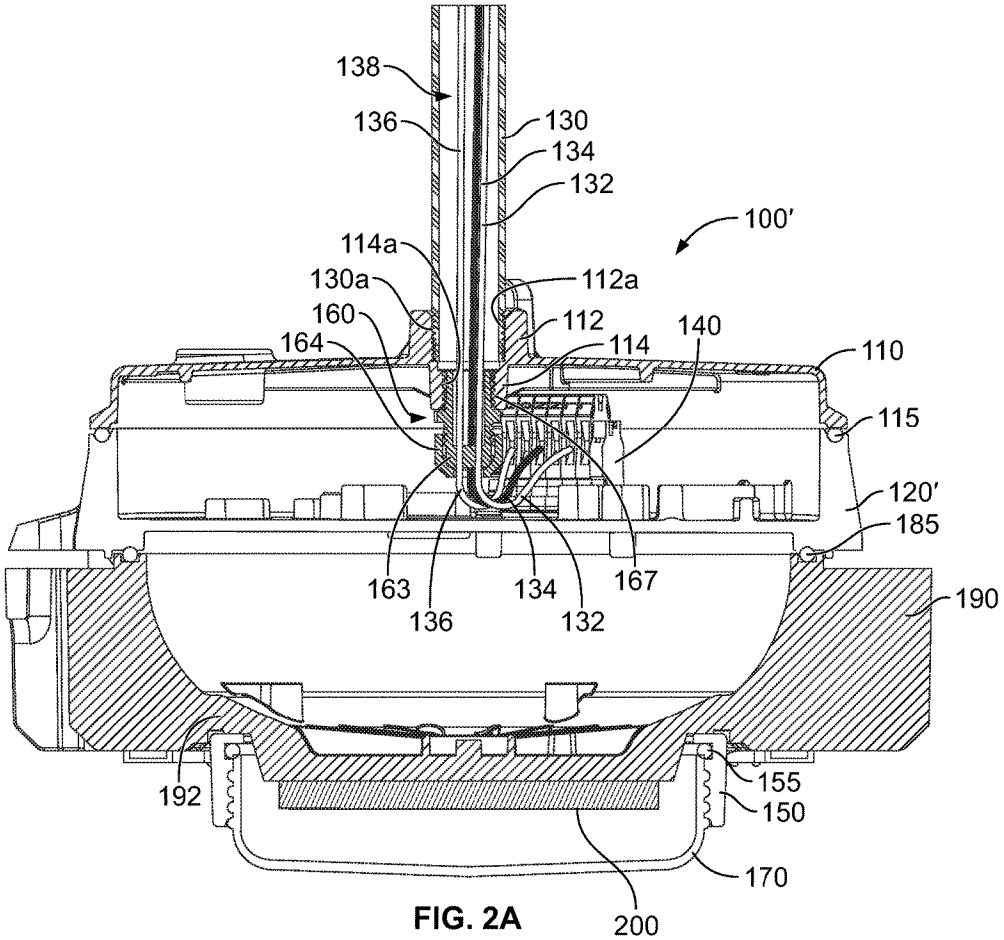

FIG. 2A is a cross-sectional view of luminaire 100' having mounting hood 110 and luminaire housing 120', and water tight cord grip 160 positioned within a lower opening in the mounting hood 110, according to an example embodiment.

Figure 2B:
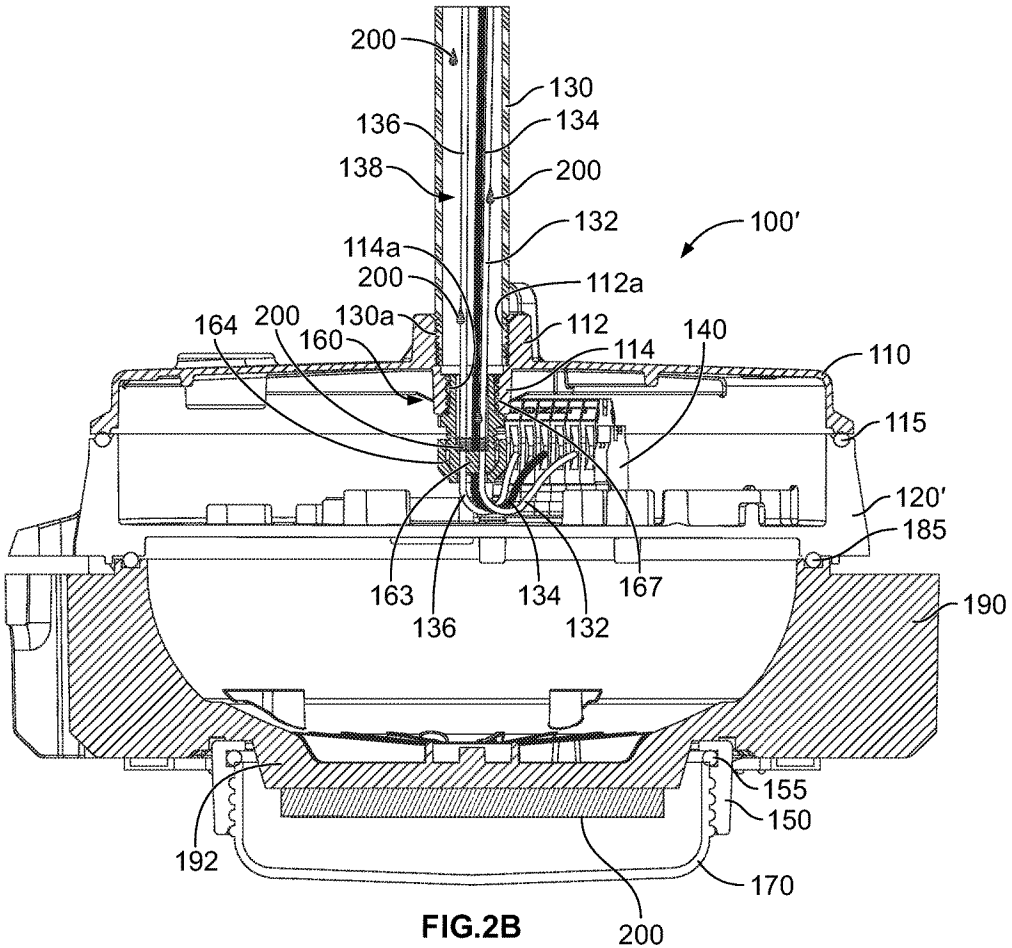

FIG. 2B is a cross-sectional view of luminaire 100' shown in FIG. 2A showing water 200 dripping through downwardly extending conduit 130 and water 200 pooling above a bottom 163 of water tight cord grip 160.

Figure 3:
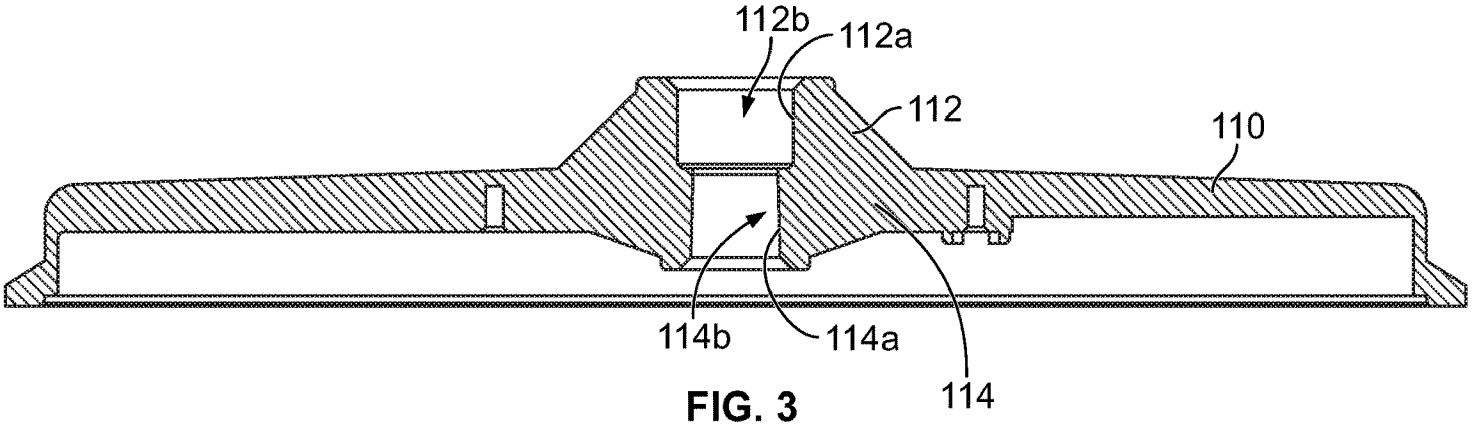

FIG. 3 is a cross-sectional view of mounting hood 110 having upper opening 112*b* and lower opening 114*b* in the interior of mounting hood 110, according to an example embodiment.

FIGS. 4A-4E provide various views of water tight cord grip 160, according to an example embodiment.

DETAILED DESCRIPTION

FIG. 1 is a cross-sectional view of luminaire 100. Luminaire or lighting device 100 includes a mounting hood 110 that may be mounted to a downwardly extending conduit 130. As shown in FIG. 1, mounting hood 110 includes an extension 112 that extends upwardly from an upper portion of mounting hood 110. Extension 112 includes internal threads 112*a*. Downwardly extending conduit 130 has external threads 130*a* on a lower end of conduit 130 that is shown threadingly engaged with internal threads 112*a* of extension 112. An upper luminaire housing 120 of luminaire 100 is shown in sealing engagement with a bottom of mounting hood 110 sealed with a gasket or O-ring 115. A translucent section 170 of the luminaire 100 is secured to the upper luminaire housing 120 via an internally threaded connector 150 positioned beneath lower end 122 of upper luminaire housing 120 of the luminaire 100 using a seal 155. An LED array 200 is shown positioned within translucent section 170 of luminaire 100.

A terminal block 140 used to direct power to lighting elements such as light emitting diodes (LEDs) is positioned on platform 180 within upper luminaire housing 120 of the luminaire 100. Electrical wires 132, 134, and 136 extend from terminal block 140.

A downwardly extending projection 114 extends into an interior of the mounting hood 110. Downwardly extending projection 114 is shown with internal threads 114*a*. A water tight cord grip 160 having an externally threaded upper portion 167 is shown in threaded engagement with internal threads 114*a* of downwardly extending projection 114. Water tight cord grip 160 includes a base 163 and a base compressing element 164 threaded onto externally threaded section 161 above the base 163, although externally threaded section 161 could be positioned outwardly from the base as well. Electrical wires 132, 134, and 136 are shown extending within interior 138 of conduit 130 through extension 112, water tight cord grip 160 and base 163, and projection 114 and into electrical connection with terminal block 140.

FIGS. 2A and 2B are cross-sectional views of luminaire 100'. Luminaire 100' includes the same mounting hood 110 shown in FIG. 1 that is shown mounted to a downwardly extending conduit 130. As shown in FIGS. 2A and 2B, mounting hood 110 includes an extension 112 that extends upwardly from an upper portion of mounting hood 110. Extension 112 includes internal threads 112*a*. Downwardly extending conduit 130 has external threads 130*a* on a lower end of conduit 130 that is shown threadingly engaged with internal threads 112*a* of extension 112. An upper luminaire housing 120' of luminaire 100' is shown in sealing engagement with a bottom of mounting hood 110 sealed with a gasket or O-ring 115. Upper luminaire section 120' of luminaire 100' is also shown in sealing engagement with a top of lower luminaire housing 190 of luminaire 100' with gasket or O-ring 185. Lower luminaire housing 190 of luminaire 100' is also secured to translucent section 170 of luminaire 100' via an internally threaded connector 150 positioned beneath lower end 192 of lower luminaire housing 190 of luminaire 100' using a seal 155. An LED 200 array is shown positioned with translucent section 170 of luminaire 100'.

Terminal block 140 used to direct power to lighting elements such as light emitting diodes (LEDs) is positioned within upper luminaire housing 120' of luminaire 100'. Electrical wires 132, 134, and 136 extend from terminal block 140.

A downwardly extending projection 114 extends into an interior of the mounting hood 110. Downwardly extending projection 114 is shown with internal threads 114*a*. A water tight cord grip 160 having an externally threaded upper portion 167 is shown in threaded engagement with internal threads 114*a* of downwardly extending projection 114. Water tight cord grip 160 includes a base 163 and a base compressing element 164 threaded onto externally threaded section 161 above the base 163. Electrical wires 132, 134, and 136 are shown extending within interior 138 of conduit 130 through extension 112, water tight cord grip 160 and base 163, and projection 114 and into electrical connection with terminal block 140.

The mounting hood 110 and luminaire housing may be sealed to prevent the ingress of debris, dust, and water, and the connection between the conduit 130 and the mounting hood 110 may also be sealed to prevent the ingress of debris, dust, and water. However, as noted above, water may enter the conduit 130 through rain water or condensation and drip downwardly towards the luminaire 100', and result in the undesirable entry of water into the luminaire 100' where it may adversely affect electrical components and/or or circuitry positioned within the luminaire. As result, even though the mounting hood 110 and luminaire housing are sealed, and even though the connection between the conduit 130 and the mounting hood 110 is sealed, it is still possible for water to drip downwardly through the interior 138 of the conduit 130 and into the luminaire 100'.

As shown in FIG. 2B, to prevent water 200 shown dripping down the interior 138 of conduit 130 and into the luminaire 100', a water tight cord grip 160 is advantageously threaded into engagement with protrusion 114 extending within the interior of mounting hood 110. Water tight cord grip 160 includes a base 163 having one or more apertures positioned therein that allow for electrical wires 132, 134, and 136 to pass therethrough. Base compressing element 164 is tightened onto an externally threaded lower section of water tight cord grip 160 which compresses the base 163 around electrical wires 132, 134, and 136 to form a water tight seal between apertures in the base 163 and the electrical wires 132, 134, and 136 extending through the base 163. As any water 200 drips downwardly through interior 138 of conduit 130, the water 200 is blocked by base 163 of water tight cord grip 160 and prevented from entering the luminaire. As shown in FIG. 2B, water 200 may pool above base 163 which serves as a dam to prevent water 200 from entering luminaire 100' where it could adversely affect the electrical components and/or circuitry within luminaire 100'.

The luminaire 100' includes an upper luminaire housing 120' and a lower luminaire housing 190 to provide for increased lumen output from luminaire 100'. The use of the upper and lower luminaire housing provides for a greater surface area to dissipate heat generated by increased lumen output.

It will be appreciated that the connections of external threads 130*a* of conduit 130 and internal threads 112*a* of extension could be reversed, such that the end of the conduit has internal (rather than external) threads and the extension 114 has external (rather than internal) threads. Similarly, the connection of internal threads 114*a* of downwardly extending protrusion 114 and external threads of water tight cord grip 160 could also be reversed such that the protrusion 114 has external (rather than internal) threads and the upper end of water tight cord grip 160 has internal (rather than external) threads.

FIG. 3 shows a cross-sectional view of mounting hood 110 with a different cross-sectional view than that shown in FIGS. 1, 2A, and 2B. Mounting hood 110 is shown having an upwardly extending extension 112 having an aperture 112*b* and internal threads 112*a* adapted for threaded connection to the externally threaded end 130*a* of conduit 130 (shown in FIGS. 1, 2A, and 2B). Mounting hood 110 also includes projection 114 with aperture 114*b* and internal threads 114*a* adapted for threaded connection water tight cord grip 160 (shown in FIGS. 1, 2A, and 2B). In FIG. 3, aperture 114*b* is shown in communication with, and positioned beneath, aperture 112*b*. Aperture 112*b* being "in communication" with aperture 114*b* means that electrical wiring may pass through both aperture 112*b* and aperture 114*b*. In addition, although aperture 114*b* is shown positioned below aperture 112*b* in the embodiment shown in FIG. 3, in other embodiments aperture 114*b* may be offset from, and not positioned beneath, aperture 112*b*.

Figure 4E:
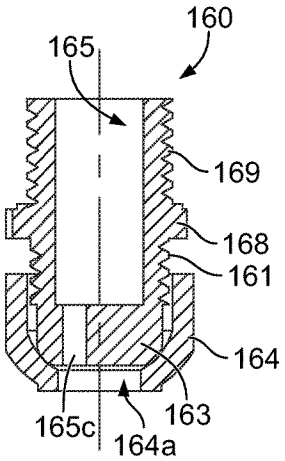
Figure 4B:
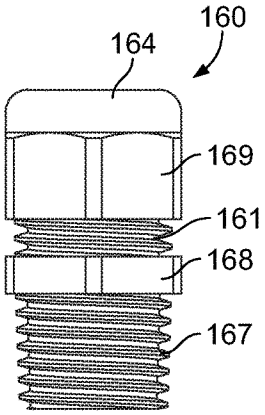
Figure 4D:
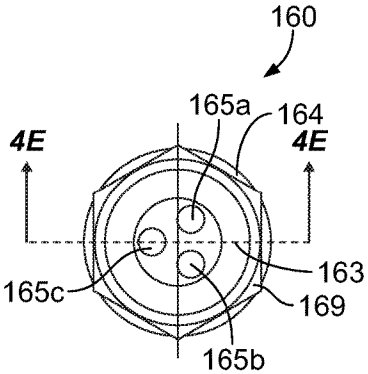
Figure 4A:
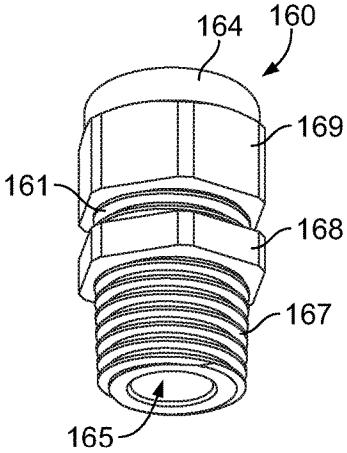
Figure 4C:
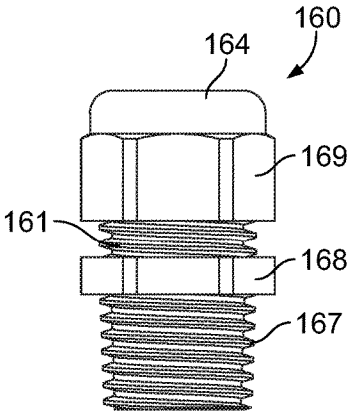

FIGS. 4A-4E show various view of water tight cord grip 160 shown in FIGS. 1, 2A, and 2B. FIG. 4A is a perspective view of water tight cord grip 160 having an externally threaded section 167 that may be threaded into the downwardly extending projection 114 of mounting hood 110. Aperture 165 is positioned within the externally threaded section 167 to allow for the passage of electrical wiring therethrough. Wrench flats 168 are also positioned on an exterior of water tight cord grip 160 to facilitate threading the externally threaded section 167 into downwardly extending projection 114 of mounting hood 110. Base compressing element 164 having wrench flats 169 is also shown, where wrench flats 169 are used to facilitate threading the base compressing element 164 on externally threaded section 161 of water tight cord grip 160. FIGS. 4B and 4C show alternate side views of water tight cord grip 160. Externally threaded section 167 is positioned adjacent wrench flats 167, and base compressing element 164 with wrench flats 169 is shown threaded onto externally threaded section 161.

FIG. 4D is a bottom view of water tight cord grip 160 shown in FIGS. 4A-4C. In FIG. 4D, openings 165*a-c* are shown in base 163 of water tight cord grip through which electrical wires may be passed. FIG. 4E is a cross-sectional view of water tight cord grip 160 taken along line 4E-4E in FIG. 4D. Threaded sections 169 and 161 may be made of a plastic material. Base 163 shown with aperture 165*c* may be made of a compressible material such as rubber. An electrical wire may be passed through aperture 165 and opening 165*c* of base 163 of water tight cord grip. When base compressing element 164 is threaded onto externally threaded section 161, compressible base 163 is compressed to squeeze the electrical wire within opening 165*c*, thereby providing a water tight seal preventing water from passing through the area between opening 165*c* and the exterior of the electrical wire. As a result, any water entering into aperture 165 of water tight cord grip 160 from conduit 130 shown in FIGS. 1, 2A, and 2B, is trapped above base 163 which serves as a dam to prevent entry of water into the luminaire.

The foregoing disclosure has been described with reference to the accompanying embodiments which do not limit the scope and ambit of the disclosure. The description provided is purely by way of example and illustration.

The embodiments herein and the various features and advantageous details thereof are explained with reference to the non-limiting embodiments set forth in the Figures. The examples used herein are intended merely to facilitate an understanding of ways in which the embodiments herein may be practiced and to further enable those of skill in the art to practice the embodiments herein.

What is claimed is:

1. A luminaire comprising:

a mounting hood; and a luminaire housing attachable to the mounting hood;

wherein the mounting hood includes an upper aperture positioned on an upper portion of the mounting hood adapted for secure engagement with a lower end of a downwardly extending conduit;

wherein the mounting hood includes a lower aperture positioned in an interior of the mounting hood which is in communication with the upper aperture of the mounting hood;

wherein the lower aperture includes first threads;

a water tight cord grip having an upper portion with second threads in threaded engagement with the first threads of the lower aperture of the mounting hood;

wherein the water tight cord grip has a base positioned beneath the upper portion of the water tight cord grip; and wherein electrical wiring may pass through one or more openings in the base and through the upper portion of the water tight cord, and also pass through the lower aperture positioned in the interior of the mounting hood and pass through the upper aperture positioned on the upper surface of the mounting hood.

2. The luminaire of claim 1, wherein the upper aperture is secured to the lower end of the downwardly extending conduit;

wherein the lower end of the downwardly extending conduit is in threaded engagement with the upper aperture of the mounting hood; and wherein water that the drips downwardly through the conduit is trapped by the base of the water tight cord grip and the water is prevented from entering the luminaire housing beyond the water tight cord grip when the luminaire housing is attached to the mounting hood.

3. The luminaire of claim 2, wherein lighting elements comprising one or more light emitting diodes are positioned within the luminaire housing.

4. The luminaire of claim 2, wherein the luminaire includes an upper luminaire housing secured to a lower section of the mounting hood, and the luminaire also includes a lower luminaire housing secured to the upper luminaire housing.

5. The luminaire of claim 2, including means for preventing water that drips downwardly through the conduit from entering the luminaire housing beyond the water tight cord grip.

6. The luminaire of claim 1, wherein the lower aperture of the mounting hood is positioned beneath the upper aperture of the mounting hood.

7. The luminaire of claim 1, wherein the base of the water tight cord grip has external threads that are in threaded engagement with an internally threaded base compressing element.

8. The luminaire of claim 1, wherein the upper aperture is positioned within an extension upwardly extending from the upper portion of the mounting hood.

9. The luminaire of claim 1, wherein the lower aperture of the mounting hood is positioned in a downwardly extending projection within the interior of the mounting hood.

10. A method of preventing the entry of water into a luminaire, including the steps of:

providing a luminaire having a mounting hood attachable to a luminaire housing, wherein the mounting hood includes an upper aperture positioned on an upper portion of the mounting hood adapted for secured engagement with a lower end of a downwardly extending conduit, wherein the mounting hood includes a lower aperture positioned in an interior of the mounting hood which is in communication with the upper aperture of the mounting hood, wherein the lower aperture includes first threads;

threading a water tight cord grip having an upper portion with second threads into engagement with the first threads of the lower aperture of the mounting hood;

securing the mounting hood to a lower end of a downwardly extending conduit;

passing electrical wiring through the upper and lower apertures of the mounting hood and through the water tight cord grip;

tightening a base compressing element into threaded engagement with a lower portion of the water tight cord grip;

providing an electrical connection between electrical wiring within the conduit and one or more lighting elements within the luminaire housing;

securing the luminaire housing to the mounting hood; and trapping water that drips down an interior of the conduit above a base of the water tight cord grip positioned beneath the upper portion of the water tight cord grip to prevent entry of the water into the luminaire housing beyond the water tight cord grip.

11. The method of claim 10, wherein the steps are performed in the order in which the steps are listed.

12. The method of claim 10, wherein the lower aperture of the mounting hood is positioned beneath the upper aperture of the mounting hood.

13. The method of claim 10, wherein the lighting elements comprise one or more light emitting diodes.

14. The method of claim 10, wherein the luminaire housing includes an upper section secured to a lower section of the mounting hood, and the luminaire housing also includes a lower section secured to the upper section of the luminaire housing.

15. The method of claim 10, wherein the base of the water tight cord grip has external threads that are in threaded engagement with the base compressing element which is internally threaded.

16. The method of claim 10, wherein the upper aperture is positioned within an extension upwardly extending from the upper portion of the mounting hood.

* * * * *